US008598774B2

(12) United States Patent
Liu et al.

(10) Patent No.: US 8,598,774 B2
(45) **Date of Patent: *Dec. 3, 2013**

(54) FIELD EMISSION DEVICE AND FIELD EMISSION DISPLAY

(75) Inventors: Peng Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 150 days.

This patent is subject to a terminal disclaimer.

(21) Appl. No.: 13/156,517

(22) Filed: Jun. 9, 2011

(65) Prior Publication Data

US 2012/0169222 A1 Jul. 5, 2012

(30) Foreign Application Priority Data

Dec. 29, 2010 (CN) ..... 2010 1 0612598

(51) Int. Cl.
*H01J 1/30* (2006.01)
*H01J 1/304* (2006.01)
*H01J 19/24* (2006.01)

(52) U.S. Cl.
USPC ..... 313/495; 313/309; 313/311; 313/497

(58) Field of Classification Search
USPC ..... 313/495–497, 309–311
See application file for complete search history.

(56) References Cited

U.S. PATENT DOCUMENTS

| | | | | |
|---|---|---|---|---|
| 7,301,268 | B2 * | 11/2007 | Kang et al. | 313/495 |
| 7,598,665 | B2 * | 10/2009 | Li et al. | 313/495 |
| 8,283,861 | B2 * | 10/2012 | Liu et al. | 313/498 |
| 2009/0236965 | A1 | 9/2009 | Liu et al. | |

FOREIGN PATENT DOCUMENTS

| | | | |
|---|---|---|---|
| CN | 1433039 | A | 7/2003 |
| CN | 1909177 | A | 2/2007 |
| CN | 101540260 | A | 9/2009 |
| JP | 2006173007 | A * | 6/2006 |

OTHER PUBLICATIONS

Machine English translation JP 2006173007 A.*

* cited by examiner

*Primary Examiner* — Mariceli Santiago
(74) *Attorney, Agent, or Firm* — Altis & Wispro Law Group, Inc.

(57) ABSTRACT

A field emission device includes an insulating substrate, a number of first electrode down-leads, a number of second electrode down-leads, and a number of electron emission units. The first electrode down-leads are set an angle relative to the second electrode down-leads to define a number of cells. Each electron emission unit is located in each cell and includes a first electrode, a second electrode, and a plurality of electron emitters. The second electrode extends surrounding the first electrode. The plurality of electron emitters located on and electrically connected to at least one of the first electrode and the second electrode. A field emission display is also provided.

10 Claims, 10 Drawing Sheets

FIELD EMISSION DEVICE AND FIELD EMISSION DISPLAY

CROSS-REFERENCE TO RELATED APPLICATIONS

This application claims all benefits accruing under 35 U.S.C. §119 from China Patent Application No. 201010612598.1, filed on Dec. 29, 2010 in the China Intellectual Property Office, disclosure of which is incorporated herein by reference. This application is related to applications entitled, "FIELD EMISSION DISPLAY", filed Jun. 9, 2011 Ser. No. 13/156,513; and "FIELD EMISSION DEVICE AND FIELD EMISSION DISPLAY", filed Jun. 9, 2011 Ser. No. 13/156,523

BACKGROUND

1. Technical Field

The present disclosure relates to a field emission device and a field emission display.

2. Description of Related Art

Field emission displays (FED) can emit electrons under the principle of a quantum tunnel effect opposite to a thermal excitation effect, which is of great interest from the viewpoints of low power consumption.

A field emission display, according to the prior art usually includes a transparent plate, an insulating substrate opposite to the transparent plate, a number of supporters, and one or more grids located on the insulating substrate. Each grid includes a pixel unit. The pixel unit includes a rectangular first electrode, a rectangular second electrode spaced from and parallel to the first electrode, at least one electron emitter connected to the first electrode, and a phosphor layer located on the second electrode. However, the brightness of the field emission display is relatively low.

What is needed, therefore, is to provide a field emission display having relatively high brightness.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission device and field emission display. In some embodiments, only one pixel unit is shown.

Figure 1:
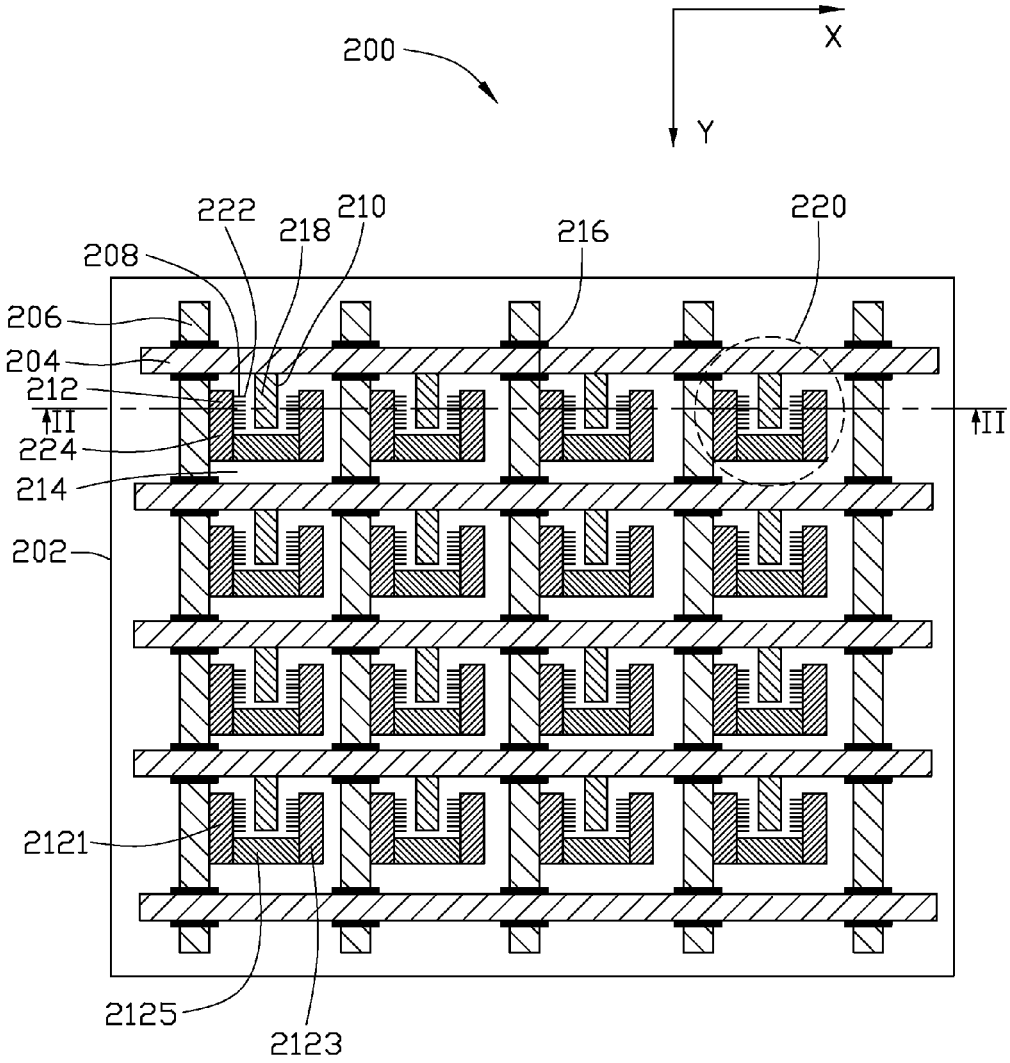
FIG. 1 is a schematic, top view of one embodiment of a field emission display.
Figure 2:
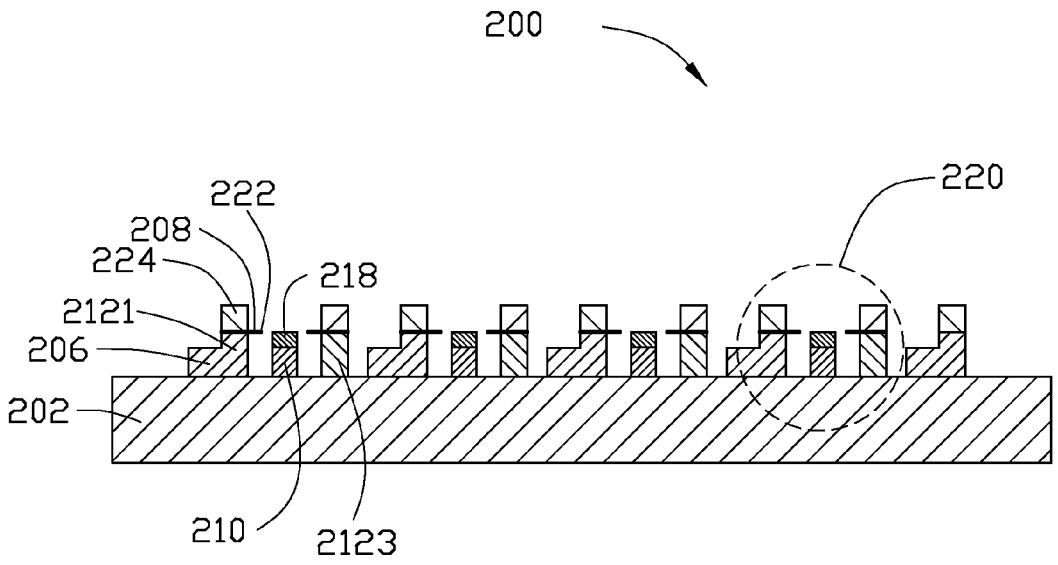
FIG. 2 is a schematic, cross-sectional view, along a line II-II of FIG. 1.

Referring to FIGS. 1 and 2, a field emission display 200 of one embodiment includes an insulating substrate 202, a number of substantially parallel first electrode down-leads 204, a number of substantially parallel second electrode down-leads 206, and a number of pixel units 220.

The first electrode down-leads 204 and the second electrode down-leads 206 are located on the insulating substrate 202. The first electrode down-leads 204 are generally set at an angle to the second electrode down-leads 206 to form a grid. A cell 214 is defined by two substantially adjacent first electrode down-leads 204 and two substantially adjacent second electrode down-leads 206 of the grid. One of the pixel units 220 is located in each cell 214. In FIG. 1, the lengthwise direction of the first electrode down-lead 204 is defined as an X direction, and the lengthwise direction of the second electrode down-leads 206 is defined as a Y direction.

The insulating substrate 202 is configured to support the first electrode down-leads 204, the second electrode down-leads 206, and the pixel units 220. The shape, size, and thickness of the insulating substrate 202 can be chosen according to need. The insulating substrate 202 can be made of material such as ceramic, glass, resin, or quartz. In one embodiment, the insulating substrate 202 is a square glass substrate with a thickness of about 1 millimeter and an edge length of about 1 centimeter.

The first electrode down-leads 204 are located equidistantly apart. A distance between two adjacent first electrode down-leads 204 can range from about 50 micrometers to about 2 centimeters. The second electrode down-leads 206 are located equidistantly apart. A distance between two adjacent second electrode down-leads 206 can range from about 50 micrometers to about 2 centimeters. Suitable orientations of the first electrode down-leads 204 and the second electrode down-leads 206 are set at an angle with respect to each other. The angle can range from about 10 degrees to about 90 degrees. In one embodiment, the angle is 90 degrees, and the cell 214 is a square area.

The first electrode down-leads 204 and the second electrode down-leads 206 are made of conductive material such as metal or conductive slurry. In one embodiment, the first electrode down-leads 204 and the second electrode down-leads 206 are formed by applying conductive slurry on the insulating substrate 202 using screen printing process, the conductive slurry being composed of metal powder, glass powder, and binder. The metal powder can be silver powder, the glass powder has a low melting point, and the binder can be terpineol or ethyl cellulose (EC). The conductive slurry can include about 50% to about 90% (by weight) of the metal powder, about 2% to about 10% (by weight) of the glass powder, and about 8% to about 40% (by weight) of the binder. In one embodiment, each of the first electrode down-leads 204 and the second electrode down-leads 206 is formed with a width in a range from about 30 micrometers to about 100 micrometers and with a thickness in a range from about 10 micrometers to about 50 micrometers. However, it is noted that dimensions of each of the first electrode down-leads 204 and the second electrode down-leads 206 can vary corresponding to the dimension of each cell 214.

The pixel unit 220 includes a first electrode 212, a second electrode 210, an electron emitter 208, and a phosphor layer 218. The first electrode 212 and the second electrode 210 are located on the insulating substrate 202 and spaced from each other. The first electrode 212 is used as a cathode electrode and electrically connected to the second electrode down-lead 206. The second electrode 210 is used as an anode electrode and electrically connected to the first electrode down-lead 204. The electron emitter 208 is located on the first electrode 212 and spaced from the second electrode 210. The phosphor layer 218 is located on a surface of the second electrode 210. In one embodiment, the electron emitter 208 is suspended above the insulating substrate 202. One end of the electron emitter 208 is electrically connected to the first electrode 212. The other end of the electron emitter 208 extends from the first electrode 212 toward the second electrode 210 and is used as an electron emission portion 222. The electron emission portion 222 is spaced from the second electrode 210. The electron emitted from the electron emitter 208 can bombard the phosphor layer 218 to light.

The second electrode 210 can be a planar conductor, such as a metal layer, an indium-tin oxide (ITO) layer, or a conductive slurry layer. In one embodiment, the second electrode 210 is cuboid. The size of the second electrode 210 can be selected according to the size of the cell 214. The second electrode 210 can have a length along the Y direction in a range from about 30 micrometers to about 15 millimeters, a width along the X direction in a range from about 20 micrometers to 10 millimeters, and a thickness in a range from about 10 micrometers to about 500 micrometers. In one embodiment, the second electrode 210 has a length along the Y direction in a range from about 100 micrometers to about 700 micrometers, a width along the X direction in a range from about 50 micrometers to about 500 micrometers, and a thickness in a range from about 20 micrometers to about 100 micrometers.

The first electrode 212 can be a planar conductor. In one embodiment, the first electrode 212 has a rectangular cross section. At least part of the first electrode 212 surrounds the second electrode 210. The first electrode 212 can be L-shaped, U-shaped, C-shaped, semicircular-shaped, or ring-shaped. In one embodiment, the first electrode 212 is U-shaped and includes a first portion 2121, a second portion 2123, and a third portion 2125. The first portion 2121 and the second portion 2123 are located on opposite sides of the second electrode 210. The third portion 2125 connects the first portion 2121 and the second portion 2123 such that the first electrode 212 surrounds the second electrode 210. The first electrode 212 and the second electrode 210 can be formed by screen printing the conductive slurry on the insulating substrate 202. As mentioned above, the conductive slurry forming the first electrode 212 and the second electrode 210 is the same as the conductive slurry forming the electrode down-leads 204, 206.

The phosphor layer 218 is located on the second electrode 210 and exposed to the electron emission portion 222 of the electron emitter 208. In one embodiment, the phosphor layer 218 is located on the entire top surface of the second electrode 210. The phosphor layer 218 can be white phosphor layer, red phosphor layer, green phosphor layer, or blue phosphor layer. The phosphor layer 218 can be formed 2 by printing, coating, or depositing. The thickness of the phosphor layer 218 can be selected according to need. In one embodiment, the thickness of the phosphor layer 218 is in a range from about 5 micrometers to about 50 micrometers.

The electron emitter 208 is located on the first electrode 212. The electron emitter 208 can be a linear emitter such as silicon wire, carbon nanotubes, carbon fibers, or carbon nanotube wires. The lengthwise direction of the electron emitter 208 can be parallel to the surface of the insulating substrate 202. The electron emission portion 222 of the electron emitter 208 points to the second electrode 210 and spaced from the second electrode 210 by a distance in a range from about 2 micrometers to about 500 micrometers. In one embodiment, the distance between the electron emission portion 222 and the second electrode 210 is in a range from about 50 micrometers to about 300 micrometers. In one embodiment, the electron emission portion 222 can extend above the phosphor layer 218.

In one embodiment, the electron emitter 208 includes a number of carbon nanotube wires evenly spaced from and in parallel with each other. All the carbon nanotube wires are arranged to form L-shaped, U-shaped, C-shaped, semicircular-shaped, or ring-shaped to surround the second electrode 210 or positioned on opposite sides of the second electrode 210. The length of the carbon nanotube wires can be in a range from about 10 micrometers to about 1 centimeter. The distance between each two adjacent carbon nanotube wires can be in a range from about 10 micrometers to about 500 micrometers. One end of the carbon nanotube wire is fixed on the first electrode 212 by a fixing electrode 224 or conductive adhesive (not shown). The carbon nanotube wire can be a substantially pure structure of the carbon nanotubes, with few impurities. The carbon nanotube wire is a free standing structure.

The carbon nanotube wire includes a plurality of successive carbon nanotubes joined end to end by van der Waals attractive force therebetween. The carbon nanotubes in the carbon nanotube wire can be single-walled, double-walled, or multi-walled carbon nanotubes. The carbon nanotube wire can be untwisted or twisted. The untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. The twisted carbon nanotube wire includes a plurality of carbon nanotubes helically oriented around an axial direction of the twisted carbon nanotube wire.

The electron emitter 208 can be formed by disposing and heating a carbon nanotube slurry layer or disposing and cutting a carbon nanotube film. The carbon nanotube slurry layer includes a number of carbon nanotubes, a glass powder, and an organic carrier. The organic carrier is volatilized during the heating process. The glass powder can be melted and solidified to form a glass layer to fix the carbon nanotubes on the first electrodes 212 during the heating and cooling process.

In one embodiment, the electron emitter 208 is made by the steps of:

step (a), providing at least one carbon nanotube film;

step (b), placing the at least one carbon nanotube film on the first electrode 212 and the second electrode 210 to cover all the first electrodes 212 and the second electrodes 210; and step (c), breaking the carbon nanotube film to form a number of carbon nanotube wires spaced from and parallel with each other.

In step (a), the carbon nanotube film can be drawn from a carbon nanotube array. Examples of carbon nanotube film are taught by U.S. Pat. No. 7,045,108 to Jiang et al., and WO 2007015710 to Zhang et al. The carbon nanotube film includes a plurality of successive and oriented carbon nanotubes joined end-to-end by van der Waals attractive force therebetween. The carbon nanotube film is a free-standing film. The term "free-standing film" means that the film can sustain the weight of itself when it is hoisted by a portion thereof without any significant damage to its structural integrity.

In step (b), when two or more carbon nanotube films are stacked on the first electrode 212 and the second electrode 210, the aligned directions of the carbon nanotubes in two adjacent carbon nanotube films is the same. All the carbon nanotubes of the carbon nanotube film extend from the first electrode 212 to the second electrode 210. In one embodiment, less than five carbon nanotube films are stacked on the first electrode 212 and the second electrode 210.

Furthermore, the carbon nanotube films are treated with a volatile organic solvent in step (b). The organic solvent is applied to soak the entire surface of the carbon nanotube film. During the soaking, adjacent parallel carbon nanotubes in the carbon nanotube film will bundle together, due to the surface tension of the organic solvent as it volatilizes, and thus, the carbon nanotube film will be shrunk into untwisted carbon nanotube wire. The organic solvent can be ethanol, methanol, acetone, dichloroethane, or chloroform.

In step (c), the carbon nanotube film can be cut by a laser beam, an electron beam, or can be broken by heat. In one embodiment, the carbon nanotube film is cut by a laser beam. The laser beam can be moved along the first electrode down-leads 204 to remove the carbon nanotubes between the first electrode down-leads 204 and the first electrode 212. The laser beam can be moved along the second electrode down-leads 206 to break the carbon nanotubes between the first electrode 212 and the second electrode 210. The power of the laser beam can be in a range from about 10 W to about 50 W. The scanning speed of the laser beam can be in a range from about 0.1 mm/sec to about 10,000 mm/sec. The width of the laser beam can be in a range from about 1 micrometer to about 400 micrometers.

Furthermore, the field emission display 200 can include a plurality of insulators 216 sandwiched between the first electrode down-leads 204 and the second electrode down-leads 206 to avoid short-circuiting. The insulators 216 are located at every intersection of the first electrode down-leads 204 and the second electrode down-leads 206 for providing electrical insulation therebetween. In one embodiment, the insulator 216 is a dielectric insulator.

Further the field emission display 200 can include a driving circuit (not shown) to drive the field emission display 200 to display. The driving circuit can control the pixel units 220 via the electrode down-leads 204, 206 to display a dynamic image. The field emission display 200 can be used in a field of advertisement billboard, newspaper, or electronic book. In use, the field emission display 200 should be sealed in a vacuum.

Figure 3:
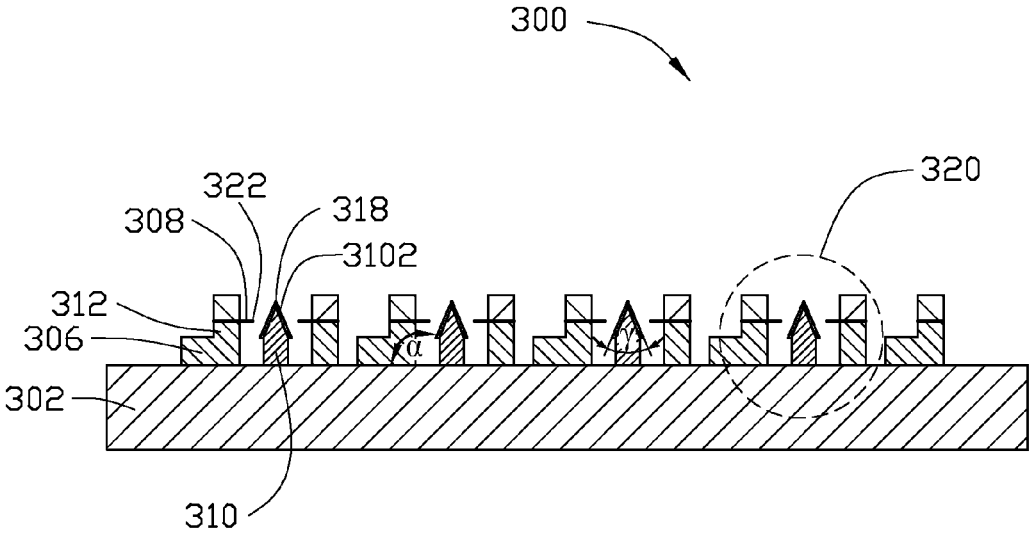
FIG. 3 is a schematic, cross-sectional view of one embodiment of a field emission display.

Referring to FIG. 3, a field emission display 300 of one embodiment includes an insulating substrate 302, a number of substantially parallel first electrode down-leads (not shown), a number of substantially parallel second electrode down-leads 306, and a number of pixel units 320. The field emission display 300 is similar to the field emission display 200 except that the second electrode 310 has a bearing surface 3102 inclined to the insulating substrate 302, and the phosphor layers 318 are located on the bearing surface 3102 and exposed to the electron emitter 308.

The bearing surface 3102 can be flat or curved. If the bearing surface 3102 is flat, an angle $\alpha$ between the bearing surface 3102 and the surface of the insulating substrate 302 can be greater than 90 degrees and less than 180 degrees. In one embodiment, the angle $\alpha$ between the bearing surface 3102 and the surface of the insulating substrate 302 is in a range from about 120 degrees to about 150 degrees. If the bearing surface 3102 is curved, the bearing surface 3102 can be a convex surface or a concave surface. The bearing surface 3102 can intersect with the insulating substrate 302 or can be spaced from the insulating substrate 302.

In one embodiment, the second electrode 310 extends along the Y direction. The width along the X direction of the second electrodes 310 decreases along a direction away from the insulating substrate 302 so that the second electrode 310 has two flat bearing surfaces 3102 adjacent to and exposed to the electron emitter 308 on the two sides of the second electrode 310. Two phosphor layers 318 are respectively located on the two bearing surfaces 3102 and exposed to the electron emission portion 322. The angle $\gamma$ between the two bearing surfaces 3102 can be in a range from about 30 degrees to about 120 degrees. In one embodiment, the angle $\gamma$ between the two bearing surfaces 3102 can be in a range from about 60 degrees to about 90 degrees. Because the phosphor layers 318 are located on the bearing surface 3102 of the second electrode 310 so that the phosphor layer 318 has a relative larger area and bombarded easily by the electron emitted from the electron emitter 308. Thus, the brightness of the field emission display 300 is improved.

The second electrode 310 can be formed by screen printing a number of stacked conductive slurry layers repeatedly. The width along the X direction of the conductive slurry layer decreases gradually. Because of the high flowability of the conductive slurry, two inclines can be formed to be used as the bearing surface 3102.

Figure 4:
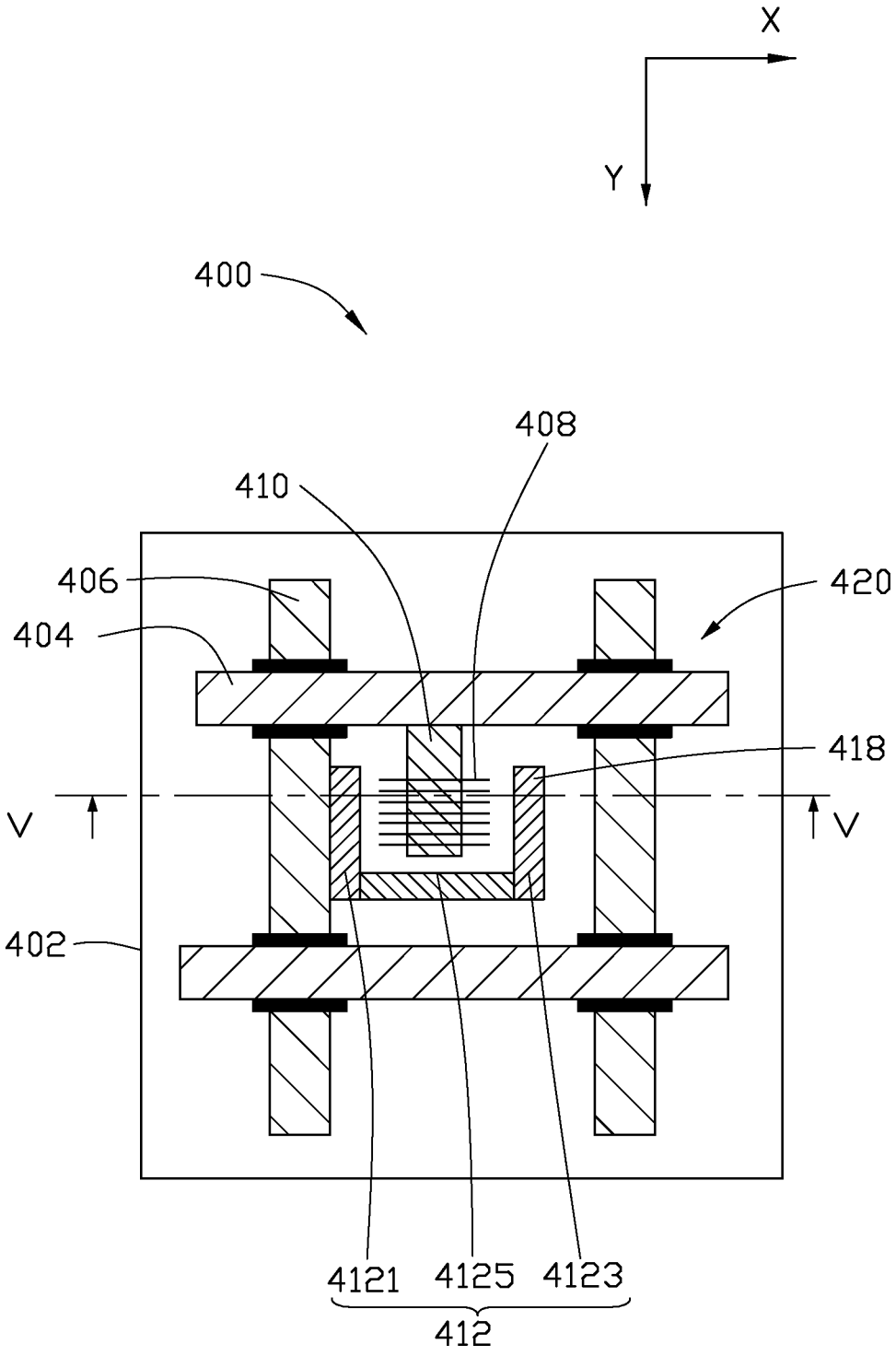
FIG. 4 is a schematic, top view of one embodiment of a pixel unit of a field emission display.
Figure 5:
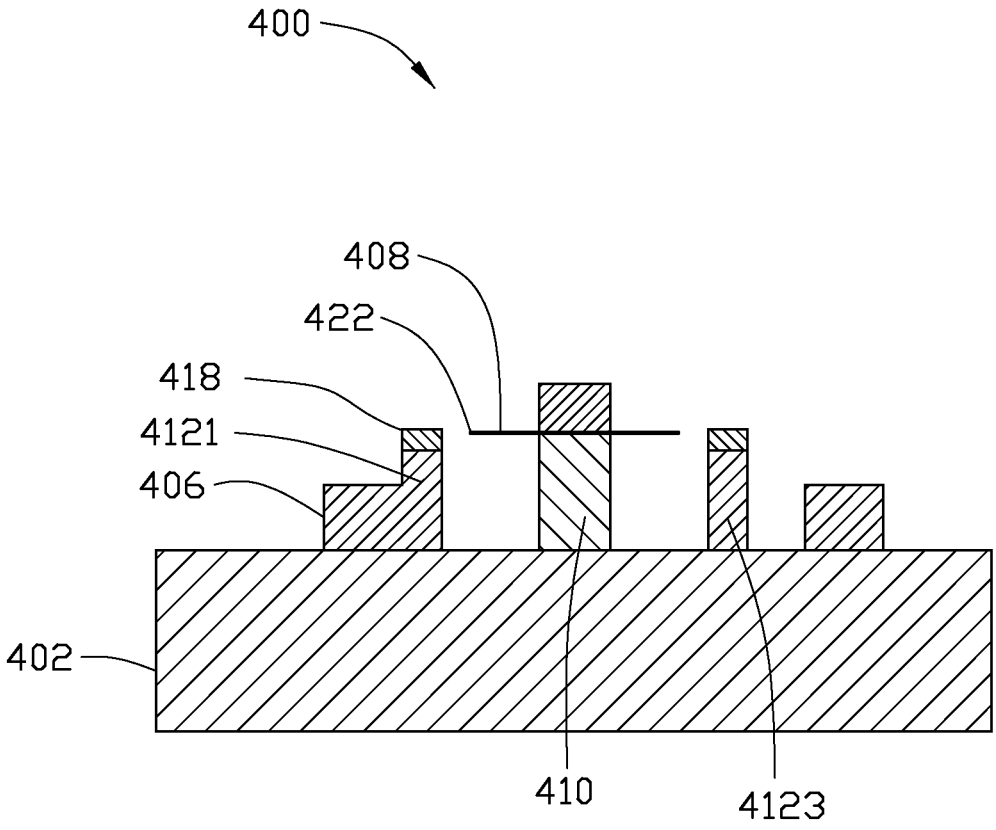
FIG. 5 is a schematic, cross-sectional view, along a line V-V of FIG. 4.

Referring to FIGS. 4 and 5, a field emission display 400 of one embodiment includes an insulating substrate 402, a number of substantially parallel first electrode down-leads 404, a number of substantially parallel second electrode down-leads 406, and a number of pixel units 420. In FIGS. 4 and 5, only one pixel unit 420 is shown. The field emission display 400 is similar to the field emission display 200 except that the first electrode 412 is used as an anode electrode, the second electrode 410 is used as a cathode electrode, the electron emitter 408 is connected to the second electrode 410, and the phosphor layer 418 is located on a top surface of the first electrode 412.

The phosphor layer 418 can have the same shape as the first electrode 412. In one embodiment, two phosphor layers 418 are respectively located on top surfaces of the first portion 4121 and the second portion 4123 of the first electrode 412. The electron emitter 408 is located on a top surface of the second electrode 410 and includes a number of electron emission portions 422. The electron emission portions 422 of the electron emitter 408 are divided into a first group and a second group. The first group of electron emission portions 422 points to the first portion 4121. The second group of electron emission portions 422 points to the second portion 4123. In one embodiment, the electron emitter 408 includes a number of carbon nanotube wires in parallel with each other and across the top surface of the second electrode 410. The first ends of the carbon nanotube wires point to the first portion 4121 and the second ends of the carbon nanotube wires point to the second portion 4123. Furthermore, a phosphor layer 418 can be located on a top surface of the third portion 4125 and part of the electron emission portions 422 points to the third portion 4125. Because both the first portion 4121 and the second portion 4123 are located on two sides of the second electrode 410 and have phosphor layers 418 located thereon, and the electron emission portions 422 of the electron emitter 408 point to the first portion 4121 and the second portion 4123 respectively, the brightness and uniformity of the field emission display 400 is further improved.

Figure 6:
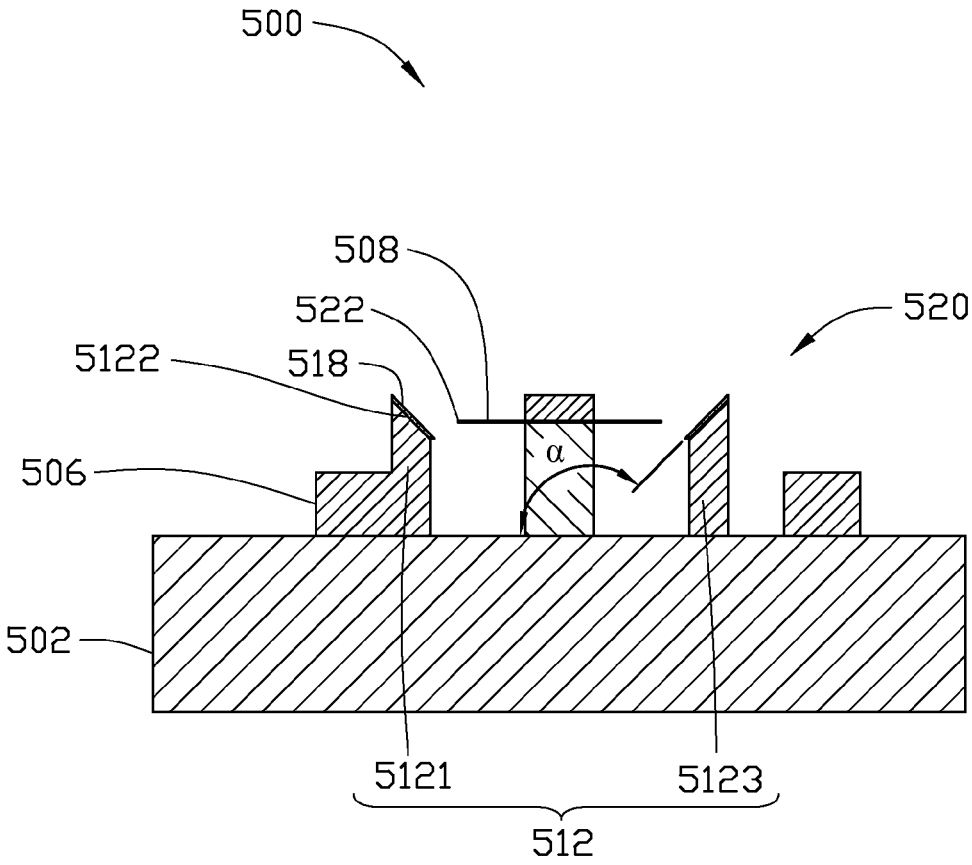
FIG. 6 is a schematic, cross-sectional view of one embodiment of a pixel unit of a field emission display.

Referring to FIG. 6, a field emission display 500 of one embodiment includes an insulating substrate 502, a number of substantially parallel first electrode down-leads (not shown), a number of substantially parallel second electrode down-leads 506, and a number of pixel units 520. In FIG. 6, only one pixel unit 520 is shown. The field emission display 500 is similar to the field emission display 400 except that both the first portion 5121 and the second portion 5123 have bearing surfaces 5122 inclined to the insulating substrate 502, and two phosphor layers 518 are respectively located on the two bearing surfaces 5122 of the first electrode 512.

In one embodiment, the width along the X direction of the first portion 5121 decreases along a direction away from the insulating substrate 502 so that the first portion 5121 has a flat bearing surface 5122 adjacent to and exposed to the electron emitter 508. The width along the X direction of the second portion 5123 decreases along a direction away from the insulating substrate 502 so the second portion 5123 has a flat bearing surface 5122 adjacent to and exposed to the electron emitter 508. The angle $\alpha$ between the bearing surface 5122 and the surface of the insulating substrate 502 can be in a range from about 120 degrees to about 150 degrees. In one embodiment, the angle $\alpha$ is about 135 degrees. Because both the first portion 5121 and the second portion 5123 have bearing surfaces 5122 and phosphor layers 518 located thereon, and the electron emission portions 522 of the electron emitter 508 points to the first portion 5121 and the second portion 5123 respectively, the brightness and uniformity of the field emission display 500 is further improved.

Furthermore, the width along the Y direction of the third portion (not shown in FIG. 6) can decrease along a direction away from the insulating substrate 502 so that the third portion has a flat bearing surface adjacent to and exposed to the electron emitter 508. The electron emitter 508 can have some electron emission portions 522 pointing to the third portion.

Figure 7:
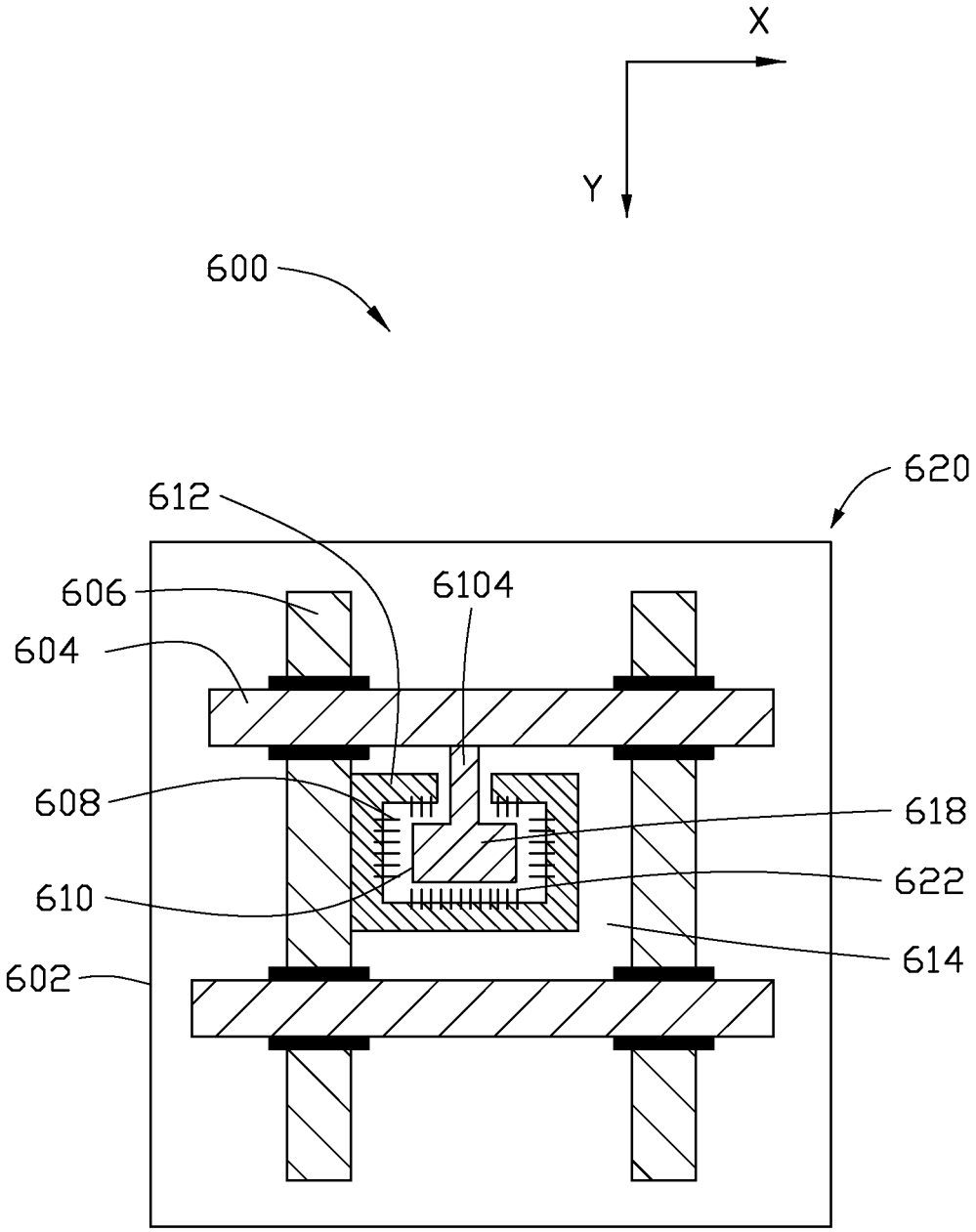
FIG. 7 is a schematic, top view of one embodiment of a pixel unit of a field emission display.

Referring to FIG. 7, a field emission display 600 of one embodiment includes an insulating substrate 602, a number of substantially parallel first electrode down-leads 604, a number of substantially parallel second electrode down-leads 606, and a number of pixel units 620. In FIG. 7, only one pixel unit 620 is shown. The field emission display 600 is similar to the field emission display 200 except that the first electrode 612 surrounds the second electrode 610, and the electron emitter 608 includes a number of carbon nanotube wires located on the first electrode 612 and arranged surrounding the second electrode 610.

In one embodiment, the second electrode 610 is located in the middle of the cell 614 and has the same shape same as the cell 614. The second electrode 610 is electrically connected to the first electrode down-leads 604 by a conductive line 6104 which can be formed with the second electrode 610 together by printing conductive slurry. The first electrode 612 extends around the second electrode 610. An insulator (not shown) can be located between the first electrode 612 and the conductive line 6104 or a gap can be formed on the first electrode 612 at the intersection of the first electrode 612 and the conductive line 6104. All of the electron emission portions 622 of the of the electron emitter 608 point to the phosphor layer 618 on the top surface of the second electrode 610. The shape of the second electrode 610 and the first electrode 612 can be C-shaped, round, square, or rectangular.

Figure 8:
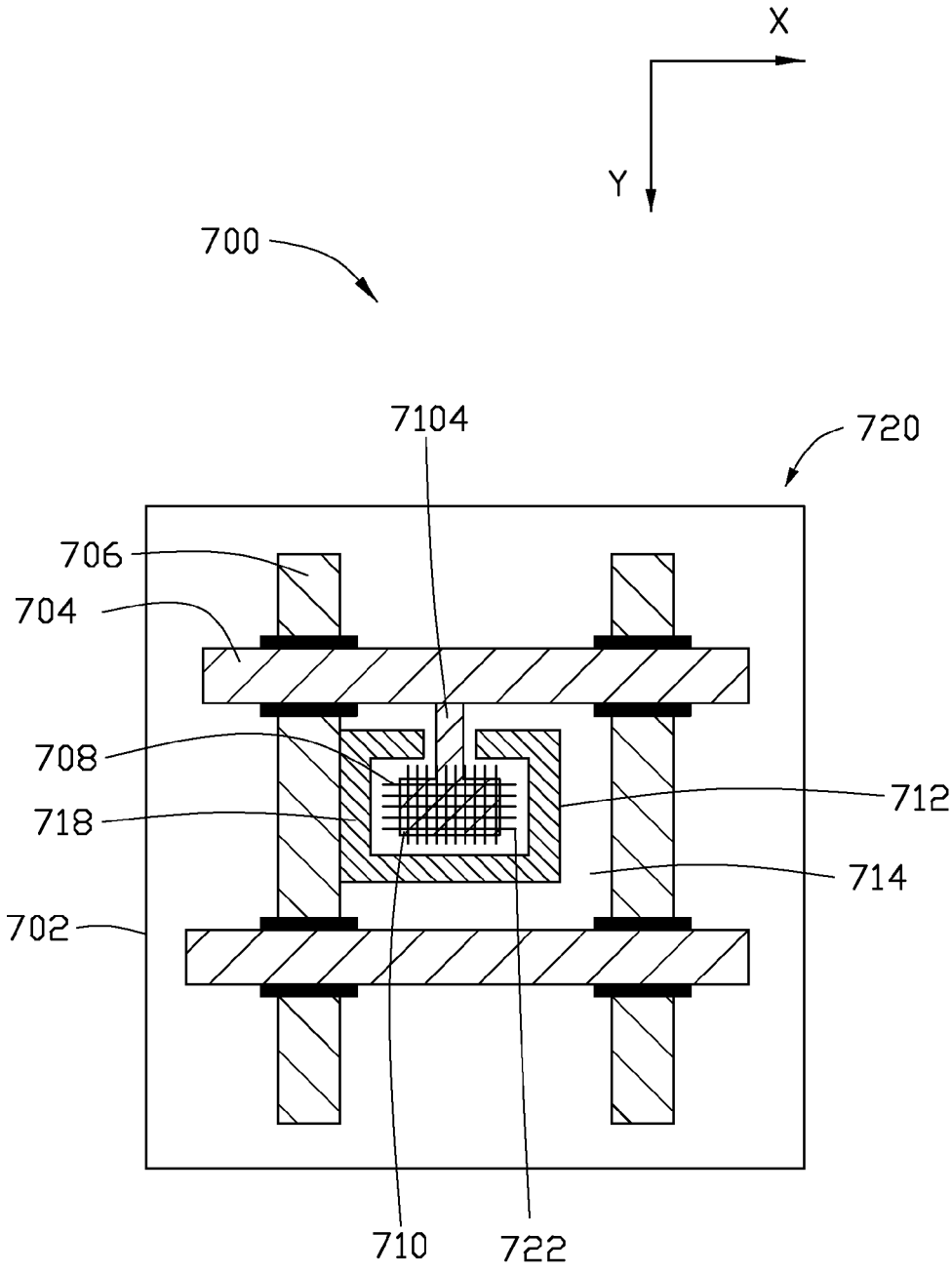
FIG. 8 is a schematic, top view of one embodiment of a pixel unit of a field emission display.

Referring to FIG. 8, a field emission display 700 of one embodiment includes an insulating substrate 702, a number of substantially parallel first electrode down-leads 704, a number of substantially parallel second electrode down-leads 706, and a number of pixel units 720. In FIG. 8, only one pixel unit 720 is shown. The field emission display 700 is similar to the field emission display 600 except that first electrode 712 is used as anode electrode, the second electrode 710 is used as cathode electrode, the electron emitter 708 includes a number of crossed carbon nanotube wires located on the second electrode 710, and the phosphor layer 718 is located on surface of the first electrode 712 and extends surrounding the second electrode 710.

In one embodiment, the second electrode 710 is located in the middle of the cell 714 and has a shape same as the shape of the cell 714. A gap is formed on the first electrode 712 at the intersection of the first electrode 712 and the conductive line 7104.

The electron emitter 708 is located on the second electrode 710 and has a number of electron emission portions 722 pointing to the phosphor layer 718 around the electron emitter 708. The electron emitter 708 can be formed by cross laying two carbon nanotube films or a number of carbon nanotube wires and cutting by laser.

Figure 9:
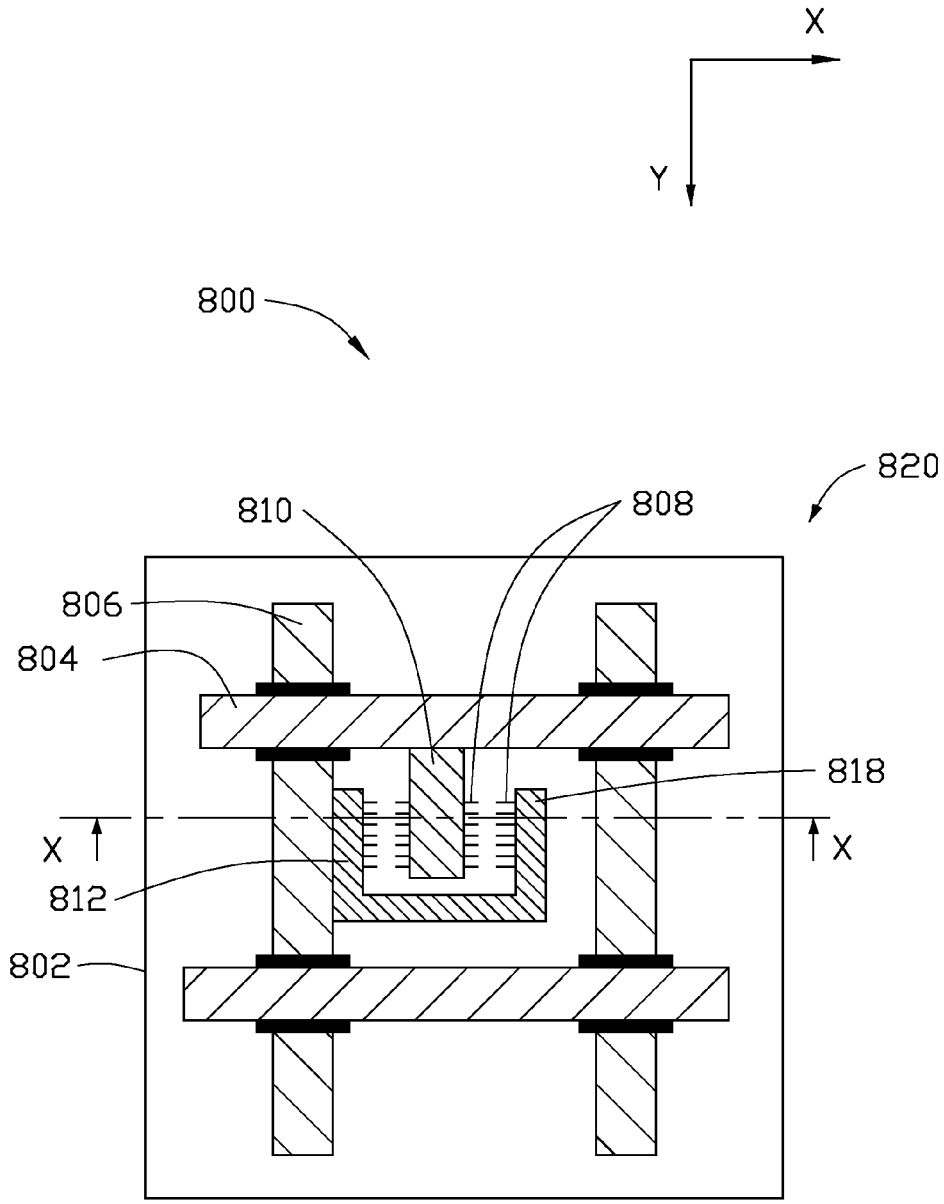
FIG. 9 is a schematic, top view of one embodiment of a pixel unit of a field emission display.
Figure 10:
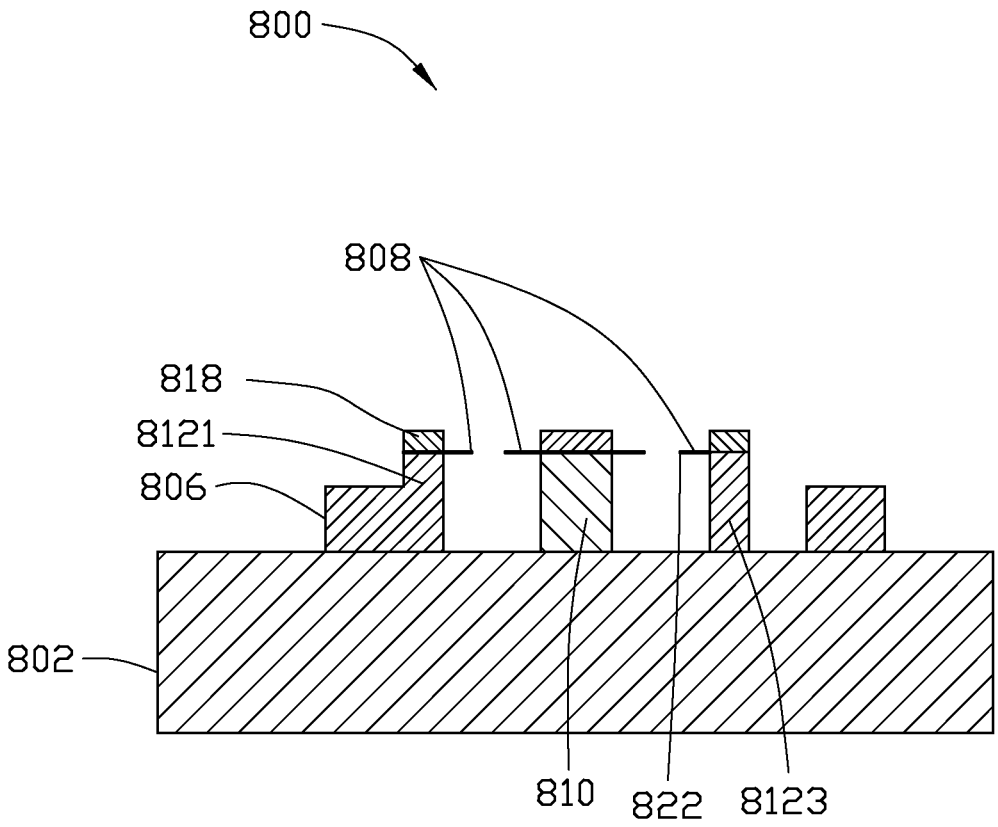
FIG. 10 is a schematic, cross-sectional view, along a line X-X of FIG. 9.

Referring to FIGS. 9 and 10, a field emission display 800 of one embodiment includes an insulating substrate 802, a number of substantially parallel first electrode down-leads 804, a number of substantially parallel second electrode down-leads 806, and a number of pixel units 820. In FIGS. 9 and 10, only one pixel unit 820 is shown. The field emission display 800 is similar to the field emission display 200 except that both the first electrode 812 and the second electrode 810 have the electron emitter 808 and the phosphor layer 818 located thereon.

In one embodiment, the electron emitter 808 includes a number of carbon nanotube wires located on the first portion 8121, the second portion 8123, and the second electrode 810. Two phosphor layers 818 are located on the first portion 8121, the second portion 8123, and the second electrode 810 to cover the electron emitter 808. The carbon nanotube wires on the first portion 8121 and the second portion 8123 extend to the second electrode 810 and have a number of electron emission portions 822 pointing to the phosphor layers 818 on the second electrode 810. The carbon nanotube wires on the second electrode 810 respectively extend to the first portion 8121 and the second portion 8123 and have a number of electron emission portions 822 pointing to the phosphor layers 818 on the first portion 8121 and the second portion 8123. Both the first electrode 812 and the second electrode 810 can be used as an anode or cathode. In one embodiment, an alternating voltage can be supplied to the first electrode 812 and the second electrode 810 so the first electrode 812 and the second electrode 810 can be used as the anode and cathode alternately in the emission display 800. Thus, the field emission display 800 can have an improved lifespan.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A field emission device, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads is set an angle relative to the plurality of second electrode down-leads to define a grid having a plurality of cells; and a plurality of electron emission units, wherein each of the plurality of electron emission units is located in each of the plurality of cells, and each of the plurality of electron emission units comprises:

a first electrode located on the insulating substrate and configured as a cathode;

a second electrode located on the insulating substrate, spaced from the first electrode, and configured as an anode, wherein the second electrode extends at least partly around the first electrode; and a plurality of electron emitters located on and electrically connected to the first electrode.

2. The field emission device of claim 1, wherein the second electrode is L-shaped, U-shaped, C-shaped, semicircular-shaped, or ring-shaped.

3. The field emission device of claim 1, wherein the second electrode comprises a first portion and a second portion located on opposite sides of the first electrode.

4. The field emission device of claim 3, wherein the plurality of electron emitters is located on the first electrode and comprises a plurality of first ends pointing to the first portion of the second electrode and a plurality of second ends pointing to the second portion of the second electrode.

5. The field emission device of claim 4, wherein the plurality of electron emitters comprises a plurality of carbon nanotube wires in parallel with each other and extending along a direction from the first portion to the second portion.

6. A field emission display, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads is set an angle relative to the plurality of second electrode down-leads to define a grid having a plurality of cells; and a plurality of pixel units, wherein each of the plurality of pixel units is located in each of the plurality of cells, and each of the plurality of pixel units comprises:

a cathode electrode located on the insulating substrate;

an electron emitter electrically connected to the cathode electrode;

an anode electrode located on the insulating substrate and spaced from the cathode electrode, wherein the anode electrode extends at least partly around the cathode electrode; and a phosphor layer located on the anode electrode and extending at least partly around the cathode electrode.

7. The field emission display of claim 6, wherein the anode electrode is L-shaped, U-shaped, C-shaped, semicircular-shaped, or ring-shaped, and the phosphor layer has a same shape as a shape of the anode electrode.

8. The field emission display of claim 6, wherein the anode electrode comprises a first portion and a second portion located on opposite sides of the cathode electrode, a first phosphor layer is located on the first portion, and a second phosphor layer is located on the second portion.

9. The field emission display of claim 8, wherein the first portion has a first bearing surface inclined to the insulating substrate, the second portion has a second bearing surface inclined to the insulating substrate, the first phosphor layer is located on the first bearing surface, and the second phosphor layer is located on the second bearing surface.

10. The field emission display of claim 8, wherein the electron emitter comprises a plurality of first electron emission portions extending toward the first phosphor layer and a plurality of second electron emission portions extending toward the second phosphor layer.

* * * * *